US010119402B2

(12) United States Patent
Scheri et al.

(10) Patent No.: US 10,119,402 B2
(45) Date of Patent: Nov. 6, 2018

(54) COMPRESSOR WHEEL OF A RADIAL COMPRESSOR OF AN EXHAUST-GAS TURBOCHARGER

(71) Applicant: BorgWarner Inc., Auburn Hills, MI (US)

(72) Inventors: Alessio Scheri, Mainz (DE); Aleksandra Dimova, Kirchheimbolanden (DE); Thomas Lischer, Neustadt (DE); Henning Scheel, Hameln (DE)

(73) Assignee: BorgWarner Inc., Auburn Hills, MI (US)

( * ) Notice: Subject to any disclaimer, the term of this patent is extended or adjusted under 35 U.S.C. 154(b) by 191 days.

(21) Appl. No.: 14/441,912

(22) PCT Filed: Nov. 14, 2013

(86) PCT No.: PCT/US2013/069972
§ 371 (c)(1),
(2) Date: May 11, 2015

(87) PCT Pub. No.: WO2014/081603
PCT Pub. Date: May 30, 2014

(65) Prior Publication Data

US 2015/0292333 A1 Oct. 15, 2015

(30) Foreign Application Priority Data

Nov. 26, 2012 (DE) ..... 10 2012 023 074

(51) Int. Cl.
*F01D 5/04* (2006.01)
*F02B 39/00* (2006.01)
(Continued)

(52) U.S. Cl.
CPC ..... *F01D 5/043* (2013.01); *F01D 5/048* (2013.01); *F01D 5/146* (2013.01); *F02B 39/00* (2013.01);
(Continued)

(58) Field of Classification Search
CPC ..... F01D 5/146; F01D 5/043; F01D 5/045; F01D 5/048; F04D 29/284; F04D 29/30
See application file for complete search history.

(56) References Cited

U.S. PATENT DOCUMENTS 2,313,413 A * 3/1943 Weske ..... F04D 19/002 415/193
2,628,768 A * 2/1953 Kantrowitz ..... F04D 21/00 415/181
(Continued)

FOREIGN PATENT DOCUMENTS

KR 1020120036932 A 4/2012

OTHER PUBLICATIONS

International Search Report in International Application No. PCT/US2013/069972, dated Feb. 12, 2014.

*Primary Examiner* — Jason Shanske
*Assistant Examiner* — Behnoush Haghighian
(74) *Attorney, Agent, or Firm* — Eric L. Doyle; Stephan A. Pendorf; Patent Central LLC

(57) ABSTRACT

A compressor wheel (1) of a radial compressor (2) of an exhaust-gas turbocharger (3), having a hub (8); and having two blade rows (9, 10) which are arranged adjacent to one another on the hub (8), a first blade row (9) forming the leading blade row, and the adjacent, second blade row (10) forming the trailing blade row, wherein the number of blades (11) of the first blade row (9) is equal to the number of blades (12) of the second blade row (10).

2 Claims, 2 Drawing Sheets

(51) Int. Cl.
*F01D 5/14* (2006.01)
*F04D 29/28* (2006.01)
*F04D 29/30* (2006.01)

(52) U.S. Cl.
CPC ..... *F04D 29/284* (2013.01); *F01D 5/045* (2013.01); *F04D 29/30* (2013.01); *F05D 2220/40* (2013.01)

(56) References Cited

U.S. PATENT DOCUMENTS

| | | | | |
|---|---|---|---|---|
| 3,167,301 | A * | 1/1965 | Whitaker | F01D 5/045 415/119 |
| 3,195,807 | A * | 7/1965 | Sheets | F01D 5/141 415/199.4 |
| 3,867,062 | A * | 2/1975 | Troller | F01D 5/146 415/194 |
| 4,599,041 | A * | 7/1986 | Stricker | F01D 5/146 415/130 |
| 4,653,976 | A * | 3/1987 | Blair | F01D 5/045 415/1 |
| 8,920,128 | B2 * | 12/2014 | Matwey | F01D 5/046 416/181 |
| 2006/0018753 | A1 * | 1/2006 | Menian | F01D 5/146 416/175 |
| 2006/0067829 | A1 | 3/2006 | Vrbas et al. | |
| 2007/0031261 | A1 * | 2/2007 | Lombard | F01D 5/048 416/203 |
| 2010/0263373 | A1 | 10/2010 | Decker et al. | |
| 2011/0318172 | A1 * | 12/2011 | Hoeger | F01D 5/142 415/181 |
| 2013/0051996 | A1 * | 2/2013 | Hoeger | F01D 9/06 415/185 |

* cited by examiner

COMPRESSOR WHEEL OF A RADIAL COMPRESSOR OF AN EXHAUST-GAS TURBOCHARGER

The invention relates to a compressor wheel of a radial compressor of an exhaust-gas turbocharger, as per claim 1.

A compressor wheel of said type has a hub around which compressor wheel blades are arranged. The compressor wheel blades have in each case a leading edge and a trailing edge. The inducted air that impinges on the compressor wheel is conveyed through the flow ducts between the blades to the compressor wheel outlet, and hereby compressed, as the hub and the blades rotate.

It is an object of the present invention to provide a compressor wheel of a radial compressor of an exhaust-gas turbocharger which makes possible an improvement of the flow of the inducted air within the compressor wheel.

The object is achieved by the features of claim 1.

By virtue of the fact that the compressor wheel according to the invention has two separate blade rows which are provided in each case with an identical number of blades, it is achieved that at least a part of the flow of the inducted air is conducted to the suction side of the second blade row that forms the compressor wheel blade row. Said orientation of the flow increases the flow impetus, which improves the surge line margin and, overall, increases the power of the compressor wheel.

Although DE 195 25 699 A1 discloses a tandem blade cascade of a turbomachine or turbo-type working machine with at least two blade rows arranged immediately one behind the other in the rotor or stator, it is provided in said tandem blade cascade arrangement that the cascade of the second or following blade row has a greater number of blades than that of the blade row arranged in front, and has a non-uniform pitch. Owing to this design and the fact that the trailing edges of the blades of the first blade row do not have a spacing to the leading edges of the blades of the second blade row, said tandem guide cascade arrangement, or a wheel having said arrangement, is unsuitable for use in the exhaust-gas turbocharger.

The dependent claims contain advantageous developments of the invention.

According to the invention, it is possible to provide an angular offset of the trailing edge of the first blade row with respect to the leading edge of the second blade row on the hub.

Furthermore, it is possible for the trailing edges of the blades of the first blade row to be spaced apart from the leading edges of the second blade row, or for said edges to overlap. Here, according to the invention, the first blade row is to be regarded as the blade row that is impinged on first by the inducted air. Accordingly, the second blade row follows the second blade as viewed in the inflow direction.

It is also possible for so-called "splitter blades" to be provided, which are to be understood to mean rearwardly offset blades, which increases the inlet cross section of the compressor and shifts the choke line to higher volume flow rates. Such additional splitter blades may be provided in asymmetrical arrangements.

It is also possible for one or more axially offset blades to be provided.

Further details, advantages and features of the present invention become apparent from the following description of an exemplary embodiment with reference to the drawing, in which:

FIG. 1 is a schematically highly simplified diagrammatic illustration of an exhaust-gas turbocharger 3 that can be provided with a compressor wheel 1 according to the invention, which compressor wheel will be explained in detail below on the basis of FIG. 2.

Figure 1:
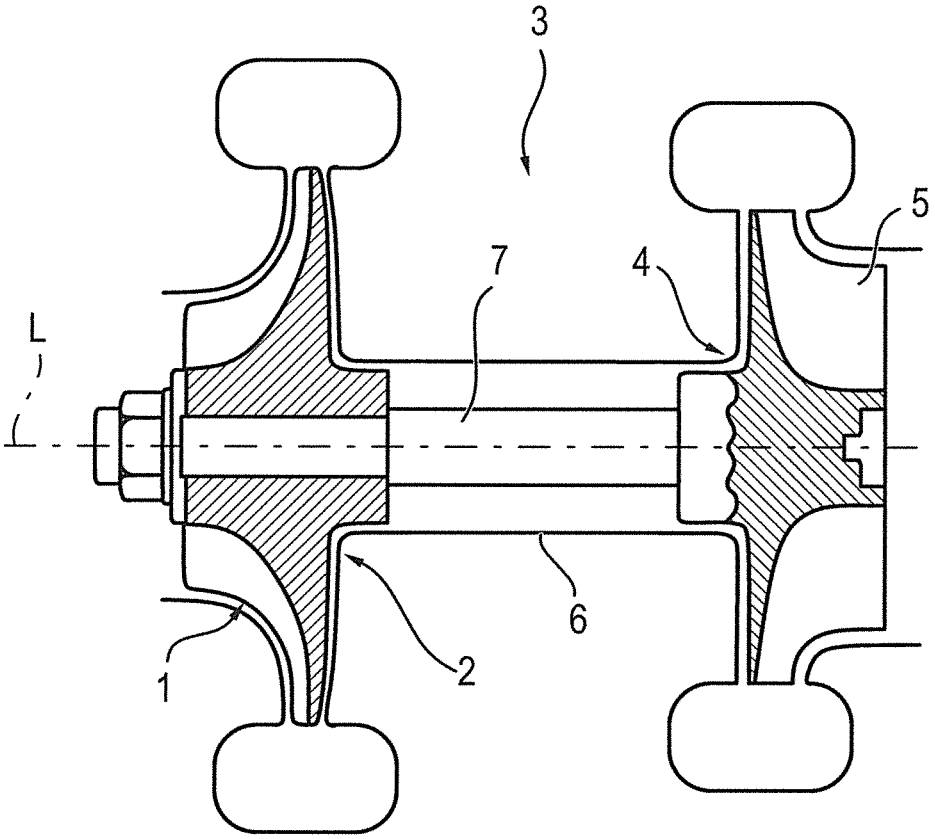
FIG. 1 is a schematically highly simplified diagrammatic illustration of an exhaust-gas turbocharger that can be provided with a compressor wheel according to the invention.

As is conventional, the exhaust-gas turbocharger 3 has a compressor 2 with the compressor wheel 1 and has a turbine 4 with a turbine wheel 5. As is conventional, said parts are arranged in a compressor housing and a turbine housing respectively, which are connected via a bearing housing 6 which serves for the mounting of a shaft for the compressor wheel 1 and the turbine wheel 5. The exhaust-gas turbocharger 3 self-evidently also has all the other conventional components of such superchargers, the explanation of which is however not necessary for the description of the principles of the present invention.

Figure 2:
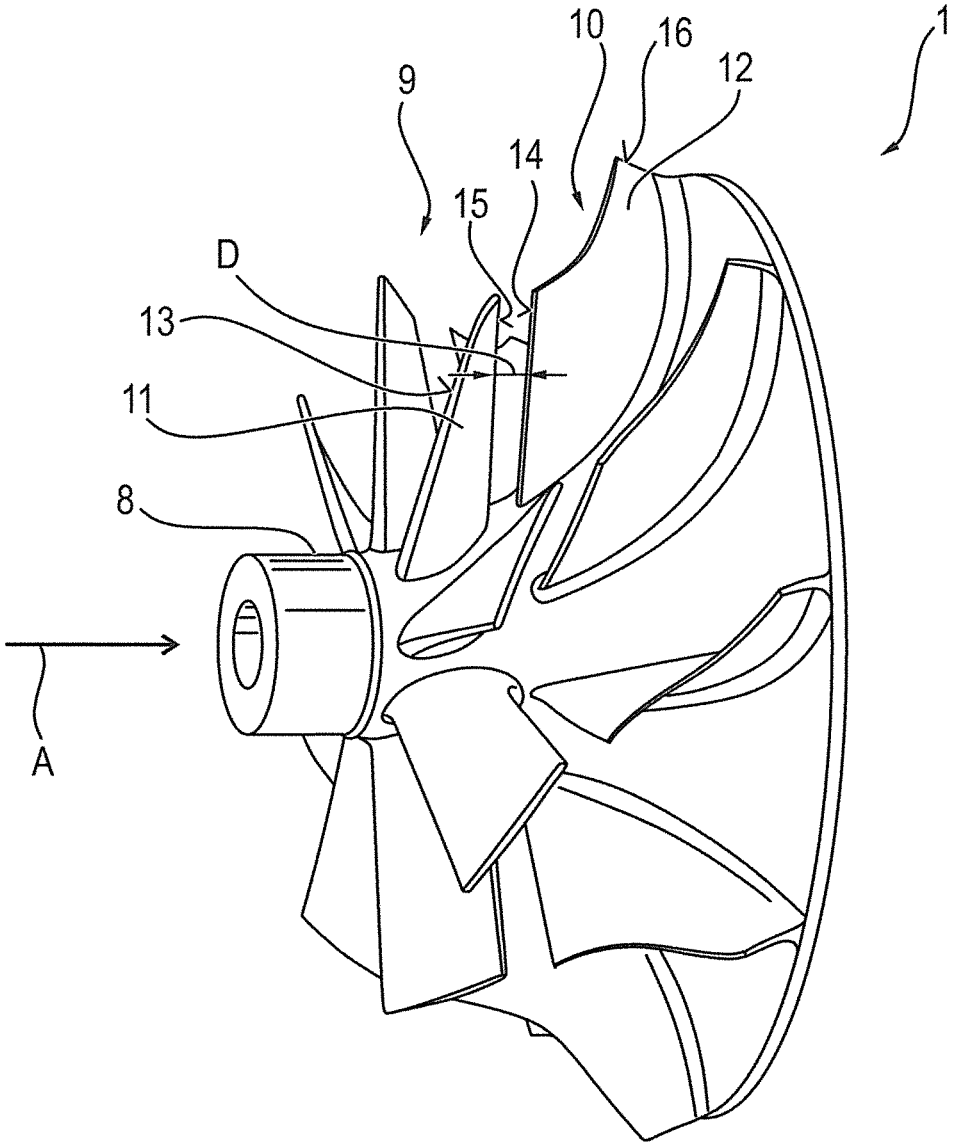
FIG. 2 shows a perspective view of an embodiment of a compressor wheel according to the invention.

FIG. 2 shows a perspective illustration of an embodiment of the compressor wheel 1 according to the invention. The compressor wheel 1 has a hub 8 on which, according to the invention, there are arranged two blade rows 9 and 10.

As viewed in the inflow direction A of the air that is inducted by the compressor 1 and to be compressed, the first blade row 9 is an inflow blade row (also referred to as pre-rotor blade row or inducer row), whereas the second blade row 10, arranged adjacent to the first blade row 9, forms an exit blade row, also referred to as impeller row.

As shown in FIG. 2, the two blade rows 9 and 10 are two separate units which are both arranged on the same hub 8.

Here, the number of blades 11 of the first blade row 9 is equal to the number of blades 12 of the second blade row 10, wherein in each case one of the blades of the first blade row 9 and one of the blades of the second blade row 10 is denoted by the said reference sign 11 and 12 respectively.

Each of the blades 11 has a leading edge 13 and a trailing edge 15.

Accordingly, each of the blades 12 of the second blade row 10 also has a leading edge 14 and a trailing edge 16.

In the embodiment illustrated in FIG. 2, a spacing D is provided between the trailing edges 15 of the blades 11 and the leading edges 14 of the blades 12.

According to the invention, however, it is also possible for the trailing edges 15 and the leading edges 14 of the first blade row 9 and of the second blade row 10, respectively, to overlap.

Although not illustrated in FIG. 2, it is also possible for the compressor wheel 1 according to the invention to be provided with at least one splitter blade.

According to the invention, the angled orientation of the blades 11 and 12 relative to the hub, or relative to the longitudinal axis thereof, may be varied in accordance with the application. Furthermore, the angled orientation of the leading edges of the blades 11 of the first blade row 9 with respect to the trailing edges 16 of the blades 12 of the second blade row 10 may likewise be varied.

In addition to the above written description of the invention, reference is hereby explicitly made, for additional disclosure thereof, to the diagrammatic illustration in FIGS. 1 and 2.

LIST OF REFERENCE SIGNS

1 Compressor wheel
2 Radial compressor

3 Exhaust-gas turbocharger
4 Turbine
5 Turbine wheel
6 Bearing housing
7 Shaft
8 Hub
9, 10 First and second blade row
11 Blades of the first blade row
12 Blades of the second blade row
13, 14 Leading edges
15, 16 Trailing edges
A Inflow direction of the inducted air
D Spacing

The invention claimed is:

1. An exhaust-gas turbocharger (3) having a radial compressor (2) including a compressor wheel (1) having a hub (8); and two blade rows (9, 10) arranged on the hub (8) including an inducer blade row (9) comprising a plurality of inducer blades and an exit blade row (10) comprising a plurality of exit blades, the blade rows cooperating for inducting air in axially, accelerating it centrifugally, and discharging air radially outward, wherein the number of inducer blades (11) of the inducer blade row (9) is equal to the number of exit blades (12) of the exit blade row (10), each inducer blade (11) cooperating with an exit blade (12) to form a blade pair, wherein each inducer blade (11) of the blade pair and each exit blade (12) of the blade pair has a leading edge (13, 14), a trailing edge (15, 16), a pressure side and a suction side, wherein a spacing (D) is provided between the trailing edge (15) of the inducer blade (11) of the blade pair and the leading edge (14) of the exit blade (12) of the blade pair as viewed in the inflow direction (A), and the exit blade (12) of the blade pair is advanced in the direction of rotation relative to the inducer blade (11) of the blade pair, and wherein all air flowing through said spacing (D) flows from the pressure side of the inducer blades to the suction side of the exit blades.

2. The exhaust-gas turbocharger as claimed in claim 1, wherein at least one splitter blade is provided.

* * * * *